US005353716A

United States Patent [19]

Wilbert

[11] Patent Number: 5,353,716

[45] Date of Patent: Oct. 11, 1994

[54] STANDING TABLE WITH A HOLLOW FORMED PEDESTAL AND A TABLE TOP

[75] Inventor: Bruno Wilbert, Hainburg, Fed. Rep. of Germany

[73] Assignee: B.W.M. Import and Export GmbH & Co. Warenvertriebs KG, Weiden, Fed. Rep. of Germany

[21] Appl. No.: 854,426

[22] Filed: Mar. 19, 1992

[30] Foreign Application Priority Data

Mar. 19, 1991 [DE] Fed. Rep. of Germany ..... 4108940
May 3, 1991 [DE] Fed. Rep. of Germany ..... 4114422

[51] Int. Cl.[5] ..... A47B 13/00

[52] U.S. Cl. ..... 108/150; 108/153; 108/159; 248/97; 248/99; 248/174

[58] Field of Search ..... 108/150, 153, 159, 161; 248/97, 99, 174

[56] References Cited

U.S. PATENT DOCUMENTS

| | | | |
|---|---|---|---|
| 1,480,681 | 1/1924 | Goes | 248/174 |
| 1,962,833 | 6/1934 | Nuckols | 248/174 |
| 2,315,608 | 4/1943 | Fergusson | 108/150 X |
| 3,705,557 | 12/1972 | Budington | 108/150 |
| 3,850,117 | 11/1974 | Martinelli | 108/150 |
| 4,760,802 | 8/1988 | Leong | 108/150 X |
| 5,018,454 | 5/1991 | Negus | 108/150 |

FOREIGN PATENT DOCUMENTS

| | | |
|---|---|---|
| 287163 | 2/1914 | Fed. Rep. of Germany . |
| 88093298 | 12/1988 | Fed. Rep. of Germany . |
| 794102 | 2/1936 | France . |
| 2573968 | 6/1986 | France . |

*Primary Examiner*—Michael Milano
*Attorney, Agent, or Firm*—Weiser & Associates

[57] ABSTRACT

A standing table with a hollow formed pedestal and a table top. The pedestal is hollow and is formed radially symmetrically, tapering upwardly. The central region of the table top is implemented so that it can be connected, through form-fitting, with upper edge regions of the pedestal. The standing table is stackable, while including a continuous table top and a separate pedestal.

21 Claims, 7 Drawing Sheets

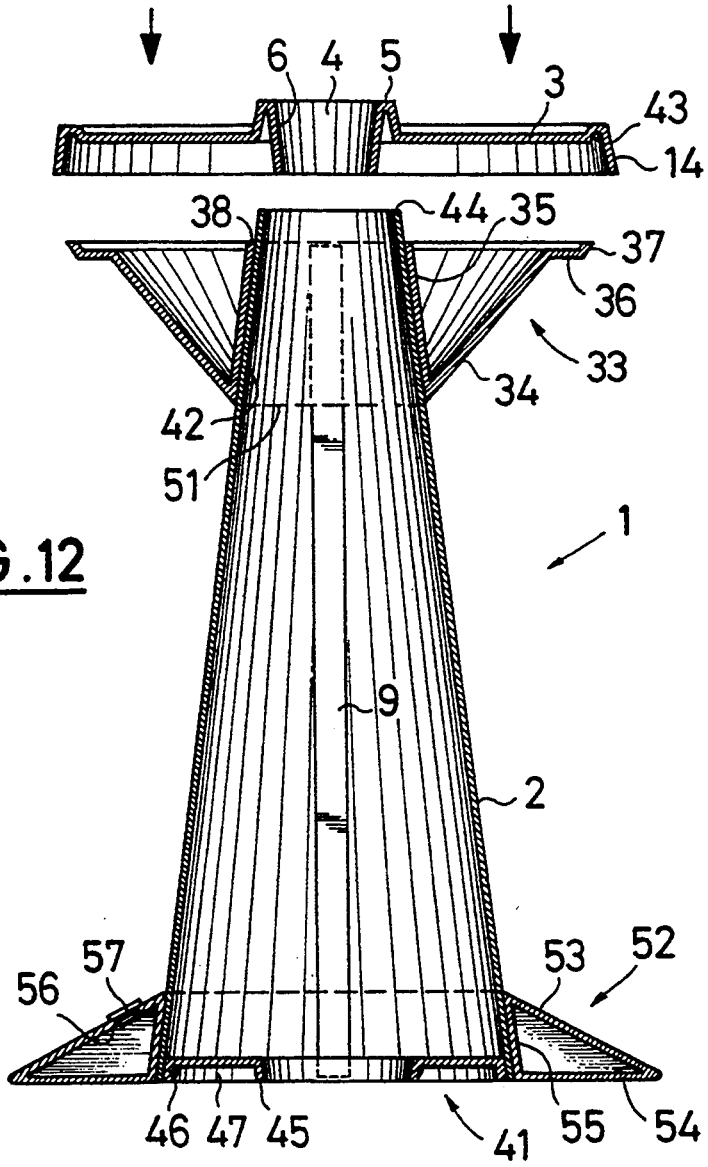
FIG.12
FIG.13
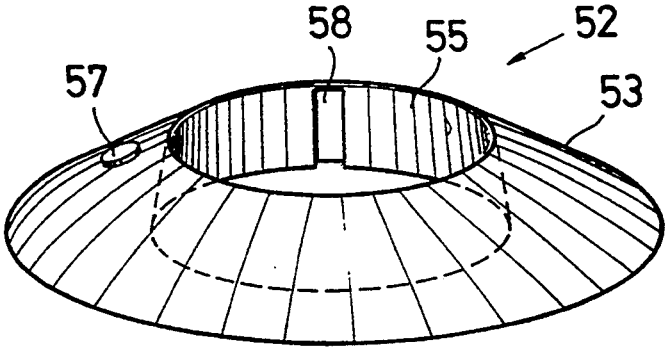

FIG.14
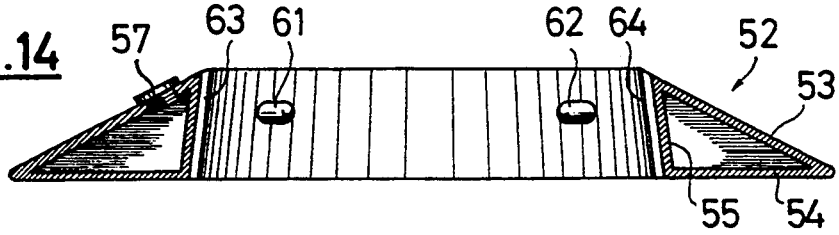
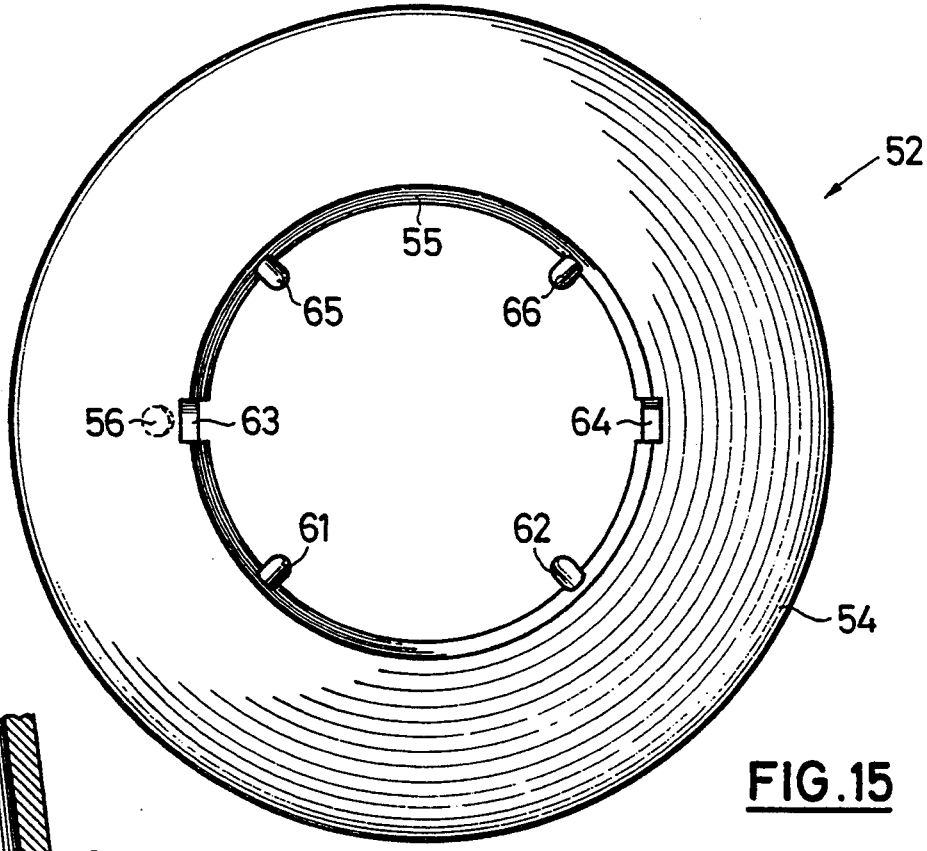
FIG.15
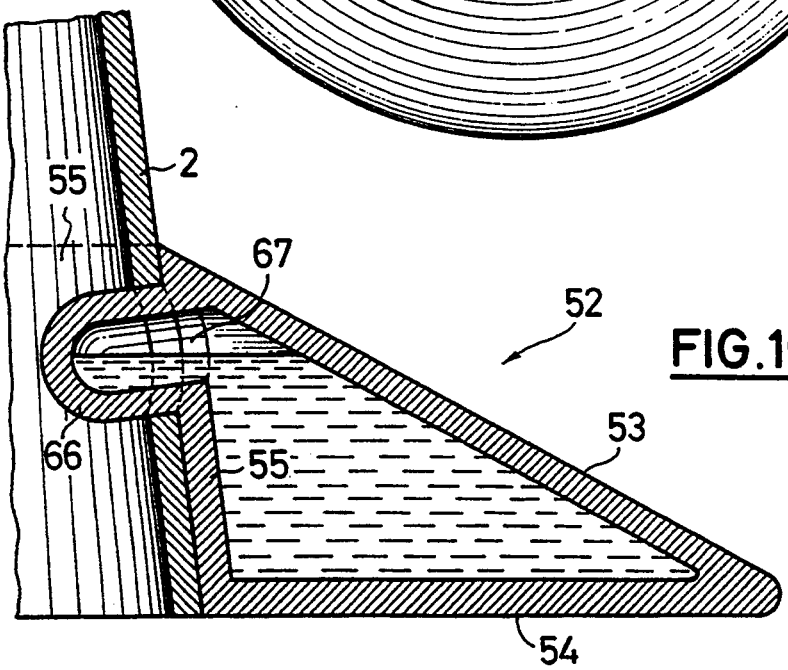
FIG.16

STANDING TABLE WITH A HOLLOW FORMED PEDESTAL AND A TABLE TOP

BACKGROUND OF THE INVENTION

This invention relates to a standing table with a hollow formed pedestal and a table top.

Standing tables of this type are used for a variety of purposes. For example, such tables can be used to present goods in a store window or for placing drinking glasses outside in the open.

As an example, DE-GM 88 09 329.8 discloses a standing table with a column-form base and a table top disposed thereon, and having a central opening for receiving an umbrella rod. The table top has a coupling piece at its underside, by which it is connected with the pedestal. This coupling piece takes the form of a tightening strap with a tension lever that can be swivelled with a handle into a detaching position. As a result, it is possible to rapidly and simply detach the table top from the pedestal. A disadvantage is, however, that this standing table is not stackable and has a relatively complicated pedestal with a central umbrella guide and a closed outer jacket.

DE-PS 287 163 discloses an umbrella table with a hollow foot which can receive a folded umbrella. This umbrella table has a table top with an upwardly extending opening for receiving an umbrella rod. A disadvantage is, however, that while the foot of the umbrella table is hollow, it is not conical on the inside. Consequently, it is not possible to stack such table feet one upon another. Stacking of the table feet is also prevented by the fact that the table top is not detachable from the table foot.

SUMMARY OF THE INVENTION

It is therefore the primary object of this invention to provide a standing table with a hollow-formed pedestal and a table top which, for reasons of cost effectiveness, can be assembled from component parts and which is very stable.

These and other objects which will be apparent are achieved in accordance with the present invention by providing a standing table with a hollow-formed pedestal and a table top wherein the inner surface of the pedestal is conically shaped and wherein the table top is connected through a form-fit with the pedestal, thereby preventing perpendicular displacement relative to the longitudinal axis of the pedestal.

As a result, the standing table is stackable, even though it has a continuous table top and a separate pedestal. Moreover, the standing table of the invention can be produced of a very thin and cost-efficient material, for example, polypropylene or sheet metal. It becomes possible to use simple production methods such as punching, deep drawing, extruding, pressing, injecting or a rotary sintering method. A further advantage of the invention is that its pedestal can be utilized for advertising purposes, including advertising text and advertising graphics, which can be applied by means of screen printing. The standing table of the invention can also serve as a waste container, or a carrier for flowers or storm lights, as well as other applications. It is even possible to introduce a light source into the pedestal of the standing table, for illuminating the pedestal.

For further detail regarding preferred embodiments of the invention, reference is made to the detailed discussion which follows, taken together with the following drawings.

BRIEF DESCRIPTION OF THE DRAWINGS

FIG. 12 is a sectional view of a variation of the assembly shown in FIG. 10.

FIG. 13 is an isometric view of the standing ring of FIG. 12, in greater detail.

FIG. 14 is a sectional view of a variation of the standing ring of FIG. 12.

FIG. 15 is a bottom plan view of the standing ring shown in FIG. 14.

FIG. 16 is a partial, sectional view of the lower area of the pedestal, with a locked standing ring.

SUMMARY OF THE INVENTION

Figure 1:
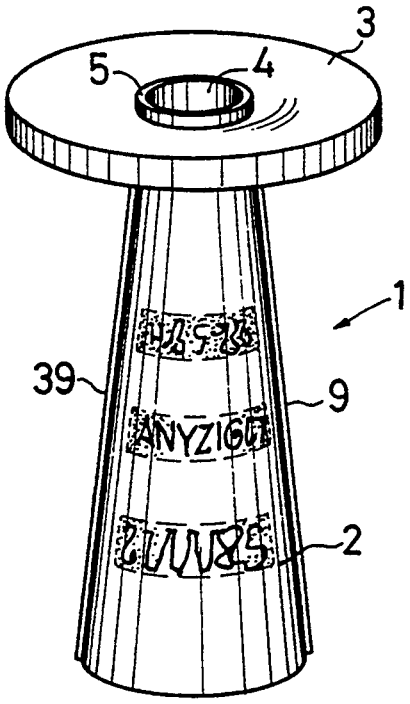
FIG. 1 is an isometric view of a standing table according to the invention.

FIG. 1 shows a full view of the standing table 1 of the invention, which generally comprises a pedestal 2 and a table top 3. The table top 3 includes, in its central region, a depression 4 surrounded by a bead 5. The circumference of the pedestal 2 (which has the form of a hollow truncated cone) can be imprinted, and can therefore serve as an advertising surface. The upper side of the table top 3 can receive drinking glasses, advertisement samples, or the like. The depression 4 can serve to hold (e.g., on festive occasions) a flower inset, or at other times, inset bowls for condiments and the like. Storm lights, candles or ash trays can also be placed in the depression 4, if desired.

Figure 2:
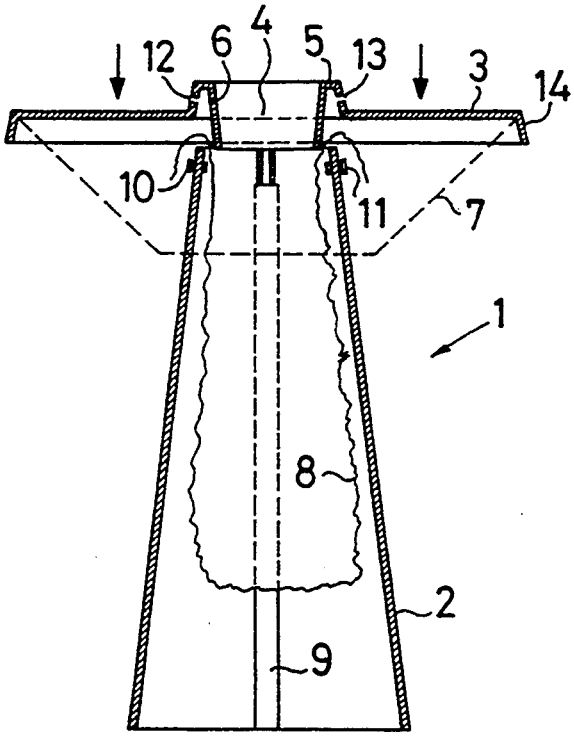
FIG. 2 is a sectional view through the standing table of FIG. 1.

In FIG. 2, the standing table 1 is depicted in longitudinal section. In this view, it can be seen that not only is the pedestal 2 implemented as a truncated cone, but so are the limiting wall 6 of the depression 4 and the cross-section of the table top 3. Also visible are a truncated cone-shaped reinforcement device 7 and a trash disposal bag 8. A fastening rail 9 for holding together the edges of the sections (films) which form the circumference of the pedestal 2 is visible from behind the trash disposal bag 8.

Assembly of the standing table 1 according to the invention essentially takes place in two steps. First, the pedestal 2 is produced (e.g., rolled) as a relatively thin synthetic film, with hooked ends for engaging the single fastening rail 9. It is also possible to provide two half shells which are hooked into two fastening rails 9, 39, if desired. Second, after completion of the pedestal 2, the table top 3 is moved from above and downwardly so that the limiting wall 6 of the depression engages an upper opening of the pedestal 2. Subsequently, the pedestal 2 and the table top 3 are connected by means of screws 10, 11, or equivalent fasteners. To this end, the screws are inserted through bores 12, 13 and into the table top, and are screwed together with the pedestal 2. The basic form of the standing table 1 is thus completed.

In one embodiment of this basic form, before the insertion of the limiting wall 6 over the upper region of the pedestal 2, a trash bag 8 may first be placed into the pedestal 2, from above, with its edge turned over the end of the pedestal 2 and toward the outside. The table top 3 is subsequently pushed downwardly so that the edge of the trash bag 8 is clamped between the pedestal 2 and the table top 3.

The conical shape of the pedestal 2 ensures a high degree of stability, even when a very thin material is selected for use (such as polypropylene of a 1 mm thickness). The table top 3 is also very stable, even though also produced of rather thin materials, which results from its cylinder-shaped circumference 12 (see FIG. 5).

A further increase in stability can be achieved using a reinforcement device 7 which has the shape of an inverted, truncated cone (see FIG. 8) which rests with its broader end 31 on the corner between the circumference 14 and the underside of the table top 3, and with its narrower end 32 supported on the outer wall of the pedestal 2.

Special embodiments of the standing table 1 are also possible. For example, the pedestal 2 may be formed of a transparent synthetic material so that a light source (not shown) disposed in the pedestal 2 can illuminate an advertising surface disposed on the circumference of the pedestal 2. This light source can advantageously be disposed adjacent to the reinforcement device 7 so that the light source itself will not be visible provided the reinforcement device is formed of a synthetic material which is not transparent to light. It is also possible to accommodate the light source in the depression 4 of the table top 3, and to provide batteries for operating the light source (for example, an incandescent lamp), in the hollow region of the reinforcement device 7.

Figure 3:
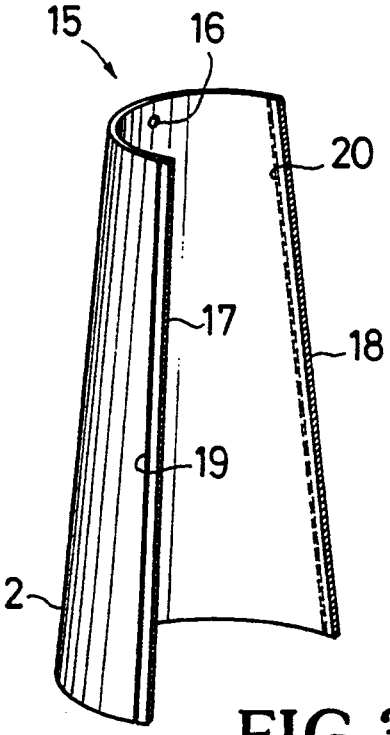
FIG. 3 is an isometric view of one-half of the pedestal of the standing table of FIG. 1.

FIG. 3 also shows, in greater detail, a section 15 of the circumference of the pedestal 2. This section constitutes one-half of the pedestal 2; the other half would be similarly constructed, but is not shown in FIG. 3. As shown, the upper region of the section 15 includes a hole 16 through which, for example, the screw 10 shown in FIG. 2 can be inserted. The outer edges 17, 18 of the section 15 are inserted into the fastening rails 9, 39, which would also serve to fasten the outer edges of the other half of the pedestal 2. As a result, such fastening can be carried out without using special tools. A groove 19, 20 is provided on the outside and in the vicinity of the outer edges 17, 18 which makes it possible to bead the ends of the section 15.

Figure 4:
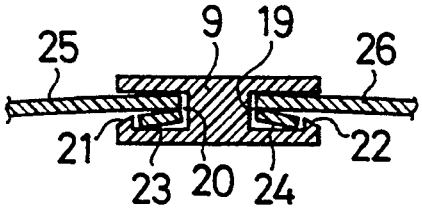
FIG. 4 is a partial, sectional view of the connection of two half-sections of the pedestal of the standing table of FIG. 1.

FIG. 4 shows the fastening rail 9 in cross-section, by which the ends of the pedestal halves are in each instance connected with one another. In this embodiment, the pedestal 2 has two such fastening rails, which oppose each other on the circumference of the stand. The fastening rail 9 essentially has the shape of a double T-beam, with openings which are provided with one ramp 21, 22 each. Using these ramps 21, 22, the ends of the synthetic film halves are inserted into the fastening rail 9, much as a snap-lock arrangement. To this end, these ends are previously bent toward the inside, which is facilitated by the grooves 19, 20 (see FIG. 3). The bent end region 23, 24 of each synthetic film half thereby forms, with its adjoining portion 25, 26, a type of barb which is prevented from falling out of the fastening rail by the ramps 21, 22.

Figure 5:
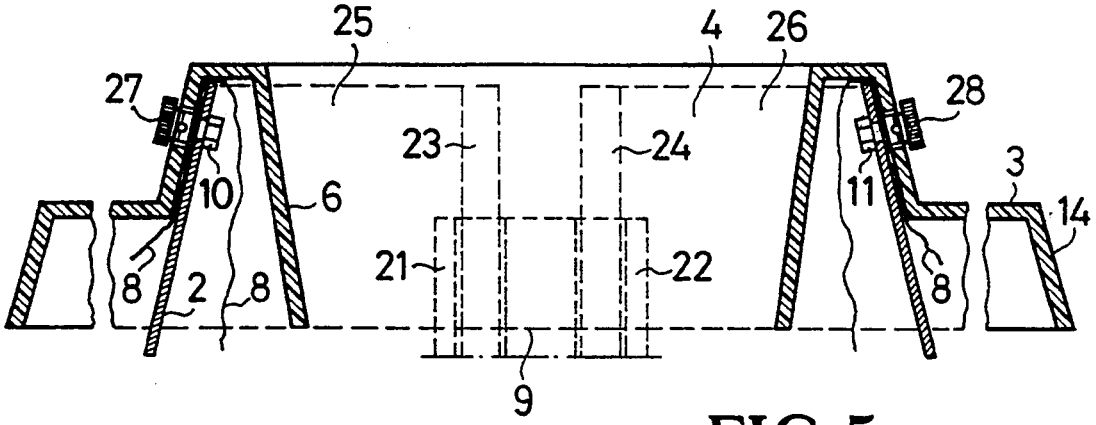
FIG. 5 is an enlarged, sectional view of the central area of the table top of a standing table.

FIG. 5 shows the upper region of the standing table 1, including the table top 3 and the upper portion of the pedestal 2, in enlarged scale. Here, the limiting wall 6 which forms the depression 4 for receiving flowers, etc., can be seen. Also visible is the trash bag 8, which can be seen clamped between the pedestal 2 and the table top 3. The table top 3 and the pedestal 2 are connected with one another with the aid of the fittings 10, 11 and the corresponding knurled nuts 27, 28. The fastening rail 9 which holds together the sections forming the pedestal 2 is shown in dashed lines.

Figure 6:
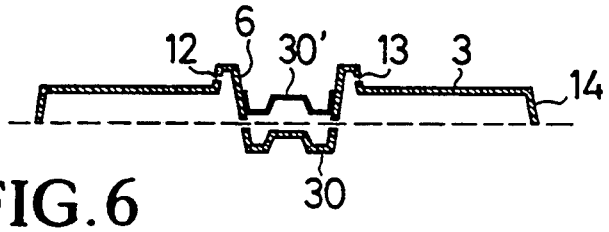
FIG. 6 is a schematic sectional view illustrating the manner of production of the table top.

FIG. 6 shows a method for producing the table top 3. The illustrated table top initially has a form which includes a "W" or "double-U" portion 30 which forms an extension of the limiting wall 6. With the aid of a cutting device, this portion 30 is separated from the limiting wall 6 so that the latter structure takes on the shape shown in FIG. 2 and FIG. 5. The portion 30 can then be used as a closure cover 30' for enclosing the recess 4.

Figure 7:
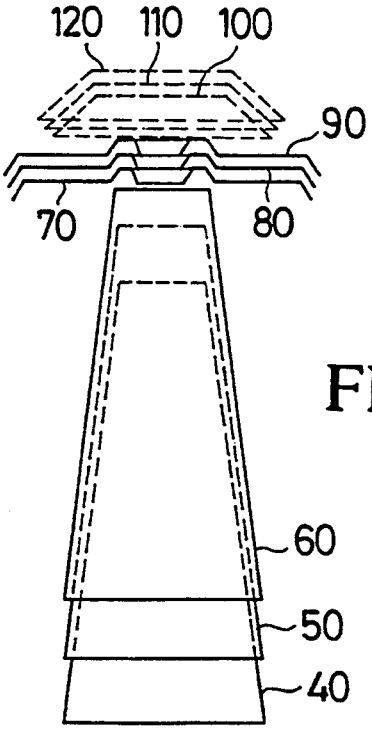
FIG. 7 is a schematic view of plural standing tables stacked one upon another.

FIG. 7 shows several standing tables according to the invention stacked one on top of another. Here, the pedestals 40, 50, 60 and the table tops 70, 80, 90 are each separately stacked one above another. If desired, the reinforcement elements 100, 110, 120 can be stacked and placed onto the table tops 70, 80, 90 which, in turn, stand on the stacked pedestals.

Figure 8:
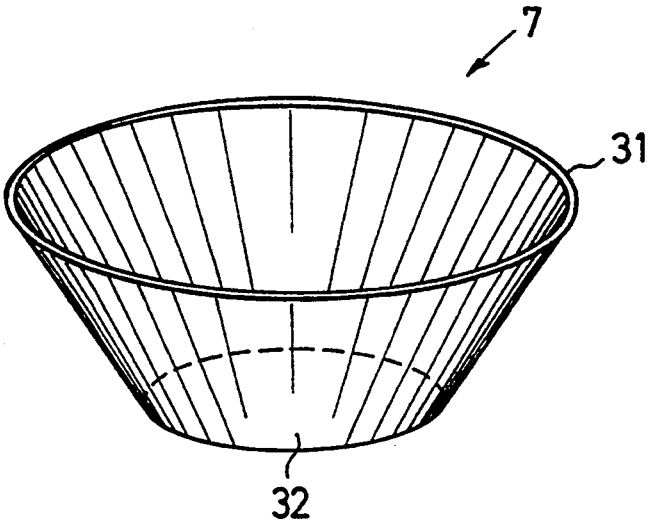
FIG. 8 is an isometric view of a first reinforcement device for the standing table of FIG. 1.

FIG. 8 shows the reinforcement device 7 indicated in FIG. 2. Here, it can be seen that the reinforcement device 7 has the shape of a truncated conical shell whose greater circumference 31 is turned upwardly and whose lesser circumference 32 is directed downwardly. The thickness of the truncated conical shell can be very small, for example, 1 mm, and yet ensure great stability.

Figure 9:
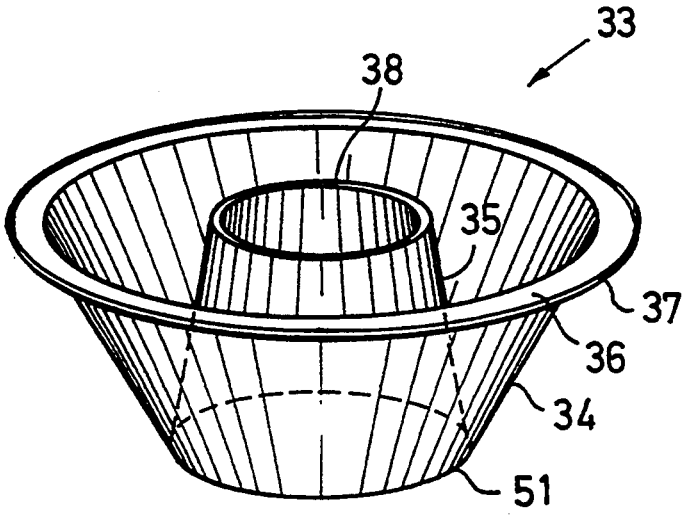
FIG. 9 is an isometric view of a second reinforcement device for the standing table.

FIG. 9 shows a second variation 33 of the reinforcement device (which looks somewhat like a cake mold) which includes a first portion 34 and a second portion 35 which, at an abutment site, seamlessly change from one to the other. The first portion 34 essentially corresponds to the reinforcement device 7 of FIG. 8, except that at the greater circumference, a collar 36 is provided with an upward curvature 37. The second portion 35 corresponds to a reduced embodiment of the reinforcement 7, wherein the greater circumference 51 is at the bottom while the lesser circumference 38 is turned upwardly.

Figure 10:
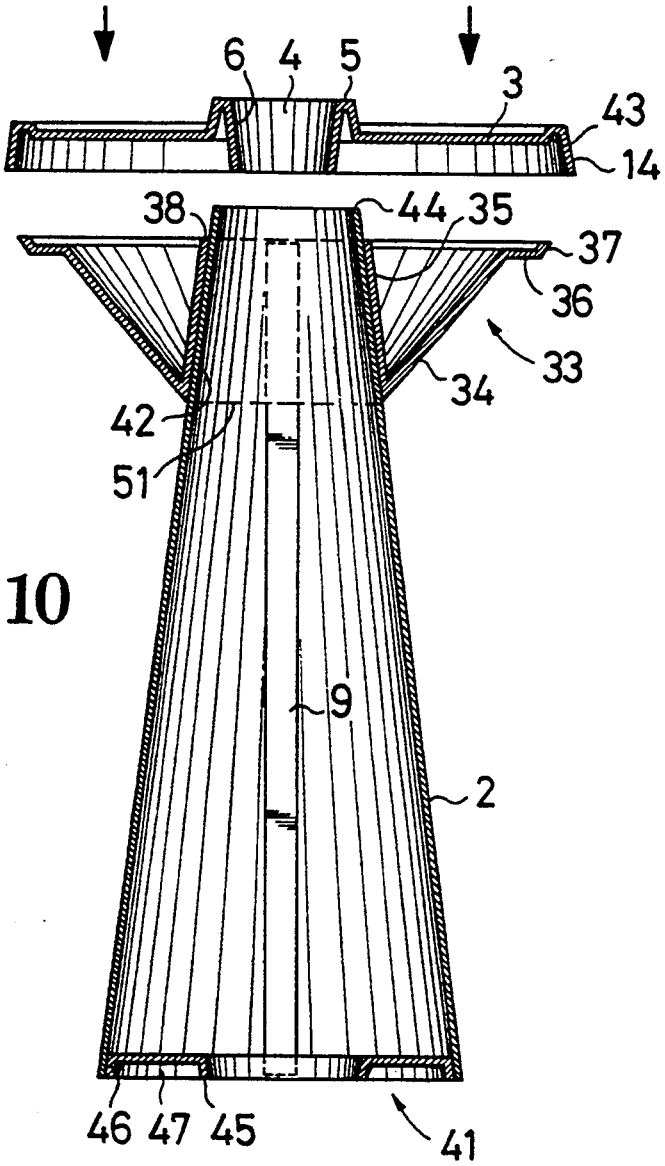
FIG. 10 is a sectional view of the second reinforcement device shown with the pedestal of a table.

FIG. 10 shows, in longitudinal section, a pedestal 2, a table top 3, and the reinforcement device 33 of FIG. 9. It can be seen in this representation that the reinforcement device 33, which is different from the reinforcement device 7, not only assists in co-supporting the table top 3, but can even support it alone. While the reinforcement device 7 of FIG. 2 only supports edge regions of the table top 3, whose central region is supported by resting on the bead 5 of the upper edge of the pedestal, the reinforcement device 33 of FIGS. 9 and 10 allows the bead in the table top 3 to be omitted since the table top 3 is only supported along its edge regions by the collar 36 having the upward curvature 37. In the case of the table top 3, the recess 4 (with the limiting wall 6) could consequently be omitted entirely. While the recess 4 and the limiting wall 6 are nevertheless depicted in FIG. 10, it is for other reasons that the recess 4 is generally of interest.

The reinforcement device 33 is simply placed, with its conical portion 35, onto the upper region 42 of the conical pedestal 2. After it has been seated firmly, the table top 3 is placed on top. This differs from the table top 3 of FIGS. 1 and 2 in that an encircling groove 43 in the edge region serves as the engagement surface for the upward curvature 37. Moreover, there are no through-holes 12, 13, because no screw connection is required. The table top 3 can have a bead 5, as in the arrangement of FIGS. 1 and 2, for engagement by the upper edge region 44 of the pedestal 2. However, as already mentioned, such a bead 5 is dispensable.

Figure 11:
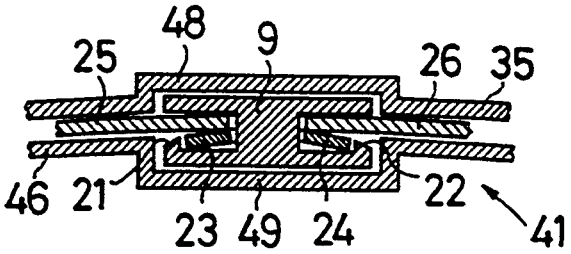
FIG. 11 is a partial, sectional view of the connection for the pedestal, also showing the reinforcement device of FIG. 10.

The reinforcement ring 41 provided in the lower region of the pedestal 2 is usefully provided with inner and outer, downwardly directed beads 45, 46. As a result, a wide groove 47 is formed between the two beads 45, 46. FIG. 11 shows a cross-section through a connection with the pedestal 2 (which corresponds in structure to the representation of FIG. 4). It can be seen that the fastening rail 9 is enclosed above and from the outside by the second portion 35 of the reinforcement device 33, while also being encompassed below and from the inside by the outer bead 46 of the reinforcement device. The second portion 35 of the reinforcement device 33 is provided with an outward protrusion 48 which is as wide as the fastening rail 9. The reinforcement ring 41 has a corresponding inward protrusion 49 whose width corresponds to the width of the fastening rail.

FIG. 12 shows a variation of the arrangement of FIG. 10 in which a standing ring 52 at the lower end of the pedestal 2 is additionally provided. This standing ring 52 serves to provide the entire standing table 1 with better stability, so that in spite of its height, it can also be used in strong winds (e.g., on a beach). This standing ring 52 has a triangular cross-section which is formed by an outer wall 53 which extends obliquely downwardly, a bottom ring 54, and an inner surface 55. The outer wall 53 includes an opening 56 which can be enclosed by a screw fitting 57. Through this opening 56, the interior of the hollow standing ring 52 can be filled with sand or a liquid so that the standing ring obtains a greater weight, providing the standing table 1 with better stability. The standing ring 52 can be turned over the pedestal 2, in the same way as the reinforcement device 33. The stackability of the standing table 1 is not limited by the standing ring 52 as long as the reinforcement ring 41 is removed.

FIG. 13 shows the standing ring 52 in isolation. It can be seen that the standing ring 52 has an inner groove 58 which serves the purpose of encompassing the fastening rail 9. As a result, the standing ring 52 is made immovable relative to the pedestal 2. The size of the groove 58 corresponds to the size of the groove which is formed by the protrusion 48 of FIG. 11.

FIG. 14 shows a cross-section through a variation of the standing ring 52 which differs from the embodiment of FIG. 13 in that it has four pins for interlocking engagement, of which the two pins 61, 62 can be seen. Apart from this, one or two additional grooves 63, 64 can be provided if desired. However, in such case, the grooves 63, 64 do not have a locking function, but rather enclose one or two of the fastening rails 9, as employed. FIG. 15 shows the standing ring 52 of FIG. 14 from below. Here, can be seen all four pins 61, 62, 65, 66, the two grooves 63, 64, as well as the inner wall 55 (extending obliquely).

FIG. 16 shows a section through the standing ring 52 of FIG. 15. The pin 66 projects through an opening 67 into the pedestal 2. The connection between the standing ring 52 and the pedestal 2 can be established in simple manner (the standing ring 52 is placed over the pedestal 2 and is slid from above, downwardly). Since the wall of the pedestal 2 is resilient, when the pins 61, 62, 65, 66 are pressed against it, the wall is bent inwardly so that the pins 61, 62, 65, 66 can be pushed up to the level of the recesses in the pedestal 2 which are provided for them. Thereafter, the pins snap in place, exhibiting the appropriate horizontal positioning. Through pressure against the pedestal 2 (with a thumb or the like), this connection can later be released. The standing ring 52 is filled with water in FIG. 16; however, it can also be filled with sand or with another material.

Figure 17:
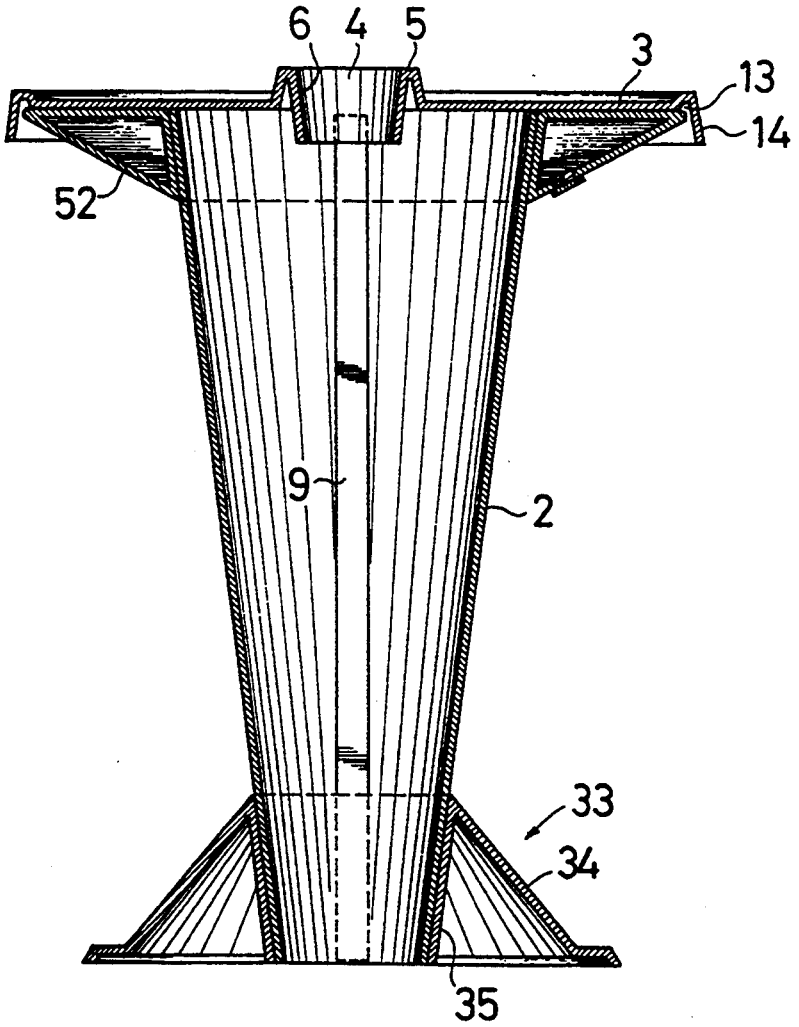
FIG. 17 is a table similar to that of FIG. 12, but which is turned over, and which has a portion of the pedestal removed.

In FIG. 17, the table of FIG. 12 is again depicted, although rotated by 180°. It can be seen that the reinforcement 33 can now serve as a device for increasing the stability of the pedestal 2, if placed on its head. So that the inverted pedestal 2 stands firmly on the ground, only the upper portion 44 (FIG. 12) needs to be cut off so that the upper edge of the pedestal 2 is aligned with the upper edge of the reinforcement 33. In this case, the standing ring 52 serves as support for the table top 3. So that the inverted device does not become top-heavy, the standing ring 52 should generally not be filled with water or sand. By configuring the components of FIG. 17, a standing table with a very different appearance can be assembled, even though the same elements are used.

I claim:

1. A standing table comprising a hollow formed pedestal including an inner surface and defining a longitudinal axis, and a table top, wherein the pedestal is comprised of a film formed into a truncated cone and having abutment sites which are connected with one another, wherein the inner surface of the pedestal is substantially conical, and wherein the table top is connected as a form fit with the pedestal and against perpendicular displacement relative to the longitudinal axis of the pedestal.

2. The standing table of claim 1, wherein at least one connection profile is provided for receiving ends of the film which forms the pedestal.

3. The standing table of claim 2, wherein the connection profile has two parallel webs, and a center web connecting the parallel webs, and wherein at least one of the parallel webs has a bilateral projection which decreases the distance between the two parallel webs.

4. The standing table of claim 3, wherein the film forming the pedestal has grooved bending line at ends thereof, for insertion into openings formed by the two parallel webs of the connection profile.

5. The standing table of claim 1, wherein the pedestal includes a plurality of films for combining to form the truncated cone, and means for connecting the films with one another at the abutment sites.

6. The standing table of claim 1, which includes a support device for surrounding the pedestal, and for supporting the table top.

7. The standing table of claim 6, wherein the support device includes a hollow reinforcement element having a truncated cone-shaped circumference with a narrower lower edge supported on outer wall portions of the pedestal and with a wider upper edge supporting edge regions of the table top.

8. The standing table of claim 6, wherein the support device has an outer portion which expands conically outwardly, and a support region for the table top.

9. The standing table of claim 6, wherein inner portions of the support device and outer regions of a corresponding reinforcement ring include recesses for engaging a fastening rail for the pedestal.

10. The standing table of claim 1, wherein lower regions of the pedestal include a standing ring for surrounding the pedestal.

11. The standing table of claim 1, wherein the table top has a central region which includes an annular and hollow bead for receiving an upper edge of the pedestal.

12. The standing table of claim 1, wherein the table top has a downwardly directed, tubular projection having a diameter which is not larger than the inner diameter of the pedestal at an upper edge thereof.

13. The standing table of claim 1, wherein the table top and the pedestal are formed of a synthetic material.

14. The standing table of claim 13, wherein the synthetic material is polypropylene having a thickness of 1 mm.

15. The standing table of claim 1, wherein the pedestal is enclosed by an inner reinforcement ring.

16. The standing table of claim 1, wherein the pedestal includes at least one elastic, flat film section which is formed as a truncated cone and which includes a grooved edge, and which further includes a fastening rail for engaging the grooved edge of the flat film section for assembling the pedestal.

17. A standing table comprising a hollow formed pedestal including an inner surface and defining a longitudinal axis, and a table top, wherein the inner surface of the pedestal is substantially conical, wherein the table top has a central region which includes an annular and hollow bead with a diameter which substantially corresponds to the diameter of upper regions of the pedestal, wherein inner portions of the bead taper conically downwardly, and outer portions of the bead taper conically upwardly, and wherein the table top is connected as a form fit with the pedestal and against perpendicular displacement relative to the longitudinal axis of the pedestal.

18. The standing table of claim 17, wherein the support region for the table top has a horizontal edge with an upwardly directed projection, and wherein the table top has a groove for engaging the projection of the support region.

19. The standing table comprising a hollow formed pedestal including an outer surface and defining a longitudinal axis, a table top, and a support device, wherein the outer surface of the pedestal is substantially conical, wherein the table top is connected as a form fit with the pedestal and against perpendicular displacement relative to the longitudinal axis of the pedestal, and wherein the support device is a truncated cone-shaped element for surrounding the pedestal which includes a narrower lower edge supported on the outer surface of the pedestal and a wider upper edge supporting edge regions of the table top.

20. The standing table of claim 19, wherein inner portions of the support device and outer regions of a corresponding reinforcement ring include recesses for engaging a fastening rail for the pedestal.

21. The standing table of claim 19, wherein the support device further includes a truncated cone-shaped collar for surrounding and engaging the pedestal which includes a wider lower edge corresponding to the lower edge of the truncated cone-shaped element and a narrower upper edge for engaging the outer surface of the pedestal.

* * * * *